US012279696B1

(12) United States Patent
Willemain

(10) Patent No.: US 12,279,696 B1
(45) Date of Patent: Apr. 22, 2025

(54) POLE-MOUNTED SHELF

(71) Applicant: Douglas F. Willemain, Belchertown, MA (US)

(72) Inventor: Douglas F. Willemain, Belchertown, MA (US)

( * ) Notice: Subject to any disclaimer, the term of this patent is extended or adjusted under 35 U.S.C. 154(b) by 0 days.

(21) Appl. No.: 18/618,032

(22) Filed: Mar. 27, 2024

(51) Int. Cl.
*A47B 96/02* (2006.01)
*A47B 57/10* (2006.01)
*A47B 96/14* (2006.01)

(52) U.S. Cl.
CPC ..... *A47B 96/024* (2013.01); *A47B 57/10* (2013.01); *A47B 96/028* (2013.01); *A47B 96/1416* (2013.01); *A47B 2230/08* (2013.01)

(58) Field of Classification Search
CPC ... A47B 96/024; A47B 96/027; A47B 96/028; A47B 37/04; A47B 96/1416; A47B 57/10; A47B 2230/08; Y10T 24/44017
USPC ..... 248/218.4, 219.4, 297.51
See application file for complete search history.

(56) References Cited

U.S. PATENT DOCUMENTS 175,407 A * 3/1876 Beaumont, Jr. ..... A63B 25/00 482/76
514,751 A * 2/1894 Higbie ..... A47B 19/002 248/297.51
1,206,203 A * 11/1916 Brockway ..... F16L 3/2235 482/76
1,460,721 A * 7/1923 Coates ..... A47C 9/06 248/240.4
2,086,280 A * 7/1937 Matter ..... A47B 57/56 482/76
3,167,292 A * 1/1965 Meyerowitz ..... A47B 96/06 248/124.2
3,778,013 A * 12/1973 Selenke ..... A63B 25/00 482/76
5,681,017 A * 10/1997 Clausen ..... F16M 11/2014 248/200.1
5,715,954 A * 2/1998 Zaremba ..... A47B 57/26 220/23.83
5,845,743 A * 12/1998 Dechant ..... E04G 5/06 248/246
8,763,821 B2 7/2014 Yang et al.
9,107,496 B2 8/2015 Lindo et al.
10,034,587 B1 7/2018 Elliot
2020/0337461 A1* 10/2020 Kareus ..... A47B 37/04

* cited by examiner

*Primary Examiner* — Ko H Chan
(74) *Attorney, Agent, or Firm* — Hanrahan Law Firm, P.A.; Benjamin M. Hanrahan

(57) ABSTRACT

A pole-mountable shelf is provided, which is configured to permit the pole to extend through and beyond the shelf. A non-cylindrical bore permits the shelf to be moved into place in a non-horizontal orientation, so that a built-in brace can clear clamps and other hardware attached to the pole. The shelf can then be rotated into a horizontal orientation, where it rests upon a pin or upon a compression clamp, which may be a telescopic clamp associated with the pole system.

20 Claims, 11 Drawing Sheets

POLE-MOUNTED SHELF

FIELD OF THE INVENTION

The present invention is generally directed to a shelf, and more specifically to an adjustable or positionable shelve that is supported by, or otherwise upon, a single pole.

BACKGROUND OF THE INVENTION

Adjustable wall shelves are well-known in the art. Typically, they involve two or more vertical support rails fixed to a wall or standing on the floor, with shelf support devices of various designs that can be mounted on the rails at a desired height. Shelves supported by a single pole are less common, but have utility where space is limited, and are often employed in bathrooms or shower stalls in the form of so-called "shower caddies."

U.S. Pat. Nos. 8,763,821, 9,107,496 and 10,034,587 are representative of single-pole shelving which describe systems wherein each shelf is individually mountable and/or slidable along a pole. In some cases, the shelf can be fixed at a desired height with an affixed compression clamp. These systems—in particular the many designs for shower caddies—have the ability to support small items, but heavy items can place excessive stress on the clamps or on the attachment points to the pole support. In addition to the torque applied to the clamp, which is proportional to the weight of the supported item and to its distance from the pole, the sheer weight of the item may overcome the friction holding the clamp to the pole.

Portable pole-mounted shelves are also commonly used on stage by DJs and musicians, for supporting small speakers, mixing boards, laptop computers, and other electronic gear. Typically, the pole for such a shelf is supported by a tripod, or by a floor-standing speaker cabinet having a receptacle in its upper surface, which is adapted to support an inserted pole. Tripod stands are well-established and popular with performers and stage hands, because their light weight and foldability make them well-suited for storage, transportation, and easy set-up. Speaker-supported poles require only an appropriately configured speaker, and are even more convenient.

However, as with the pole-mounted shelving described above, tripod- and speaker-mounted poles are limited in their ability to securely support heavy items, unless the center of mass of the item is located close to the axis of the pole. An off-centered mass stresses the shelf attachment hardware, and in the case of a tripod stand, it also makes the assembly vulnerable to accidentally being tipped over by a stagehand or performer. The need for central placement of the center of mass also renders such systems incapable of supporting multiple objects, as the support pole cannot extend past the shelf and its supported object. Indeed, most pole supports are designed to hold a single item, typically a smaller speaker, at the top of the pole, and no provision is made for attaching a shelf below it. Shelves capable of being clamped to intermediate locations on the pole have limited load-bearing capacity, due to the stress put on the clamp by off-centered masses, and even the most stable and wide-based tripods do not adequately address this problem.

As with the shower caddies discussed above, shelves and clamps can be strengthened to accommodate larger loads and larger forces, but this comes at the cost of greater weight and higher material costs and manufacturing expense. Pole-mounted shelves also tend to provide an unstable platform that is prone to tilting, unless their construction and mounting hardware are unusually rigid.

There remains a need for a stable, sturdy and cost-effective pole-mounted shelf that can securely support heavy items, and in particular heavy items placed off-center, while leaving the upper end of the pole free to support additional loads.

SUMMARY OF THE INVENTION

At least one embodiment of the present invention provides a pole-mounted shelf wherein the pole passes through a bore drilled, or otherwise formed through the shelf, so that the pole can be further used to support additional items above the shelf. The lower surface of the shelf is provided with a brace that transfers off-center forces back to the pole. In at least one embodiment, the shelf, bore and brace are configured to drop or mount directly onto existing pole fixtures, in particular the various compression clamps used to fix telescoping pole sections in place relative to one another. The shelf may be supported by the compression clamp itself, and/or by one or more pins inserted through the pole, in those cases where the pole is provided with perforations for such pin(s). The brace is so situated that it contacts the pole below the clamp or pin(s) when the shelf is in a level, horizontal or operable position.

The shelf of at least one embodiment of the present invention, by taking advantage of vertically fixed elements of the pole system to provide vertical support, entirely avoids the need to incorporate clamping hardware. Advantages in stability, weight capacity, cost and weight over prior art shelves are obtained through a simple but ingenious design.

Furthermore, in at least one embodiment, the bore through which the pole passes is shaped so that the shelf can be placed over the pole in a non-perpendicular orientation (e.g., an angled orientation relative to the pole or pole axis), and then rotated into a perpendicular (i.e. level) orientation relative to the pole or pole axis. Accordingly, in some embodiments, the bore does not have the shape of a right circular cylinder. Rather, the bore of at least one embodiment has the shape of a volume swept out by a cylinder as it is rotated from a position perpendicular to the shelf (e.g., forming a right circular cylinder) to an orientation at an angle to the shelf (e.g., forming an oblique cylinder). In alternative embodiments, the bore may have the shape of an elliptical or stadium-shaped right cylinder, or equivalents thereof.

BRIEF DESCRIPTION OF DRAWINGS

Like reference numerals refer to like parts throughout the several views of the drawings provided herein.

DETAILED DESCRIPTION OF THE INVENTION

Figure 1:
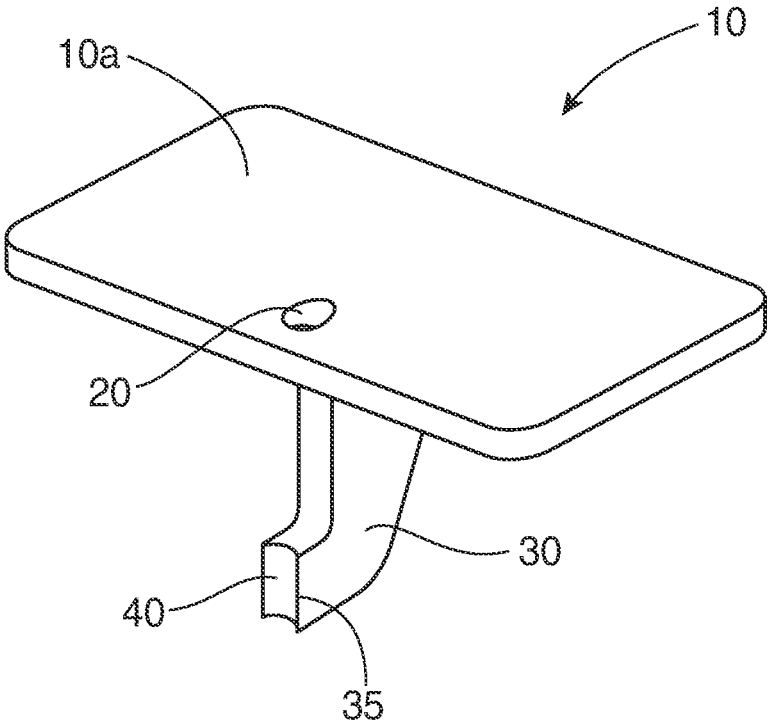
FIG. 1 is a top perspective view of a shelf as disclosed according to at least one embodiment of the present invention.
Figure 2:
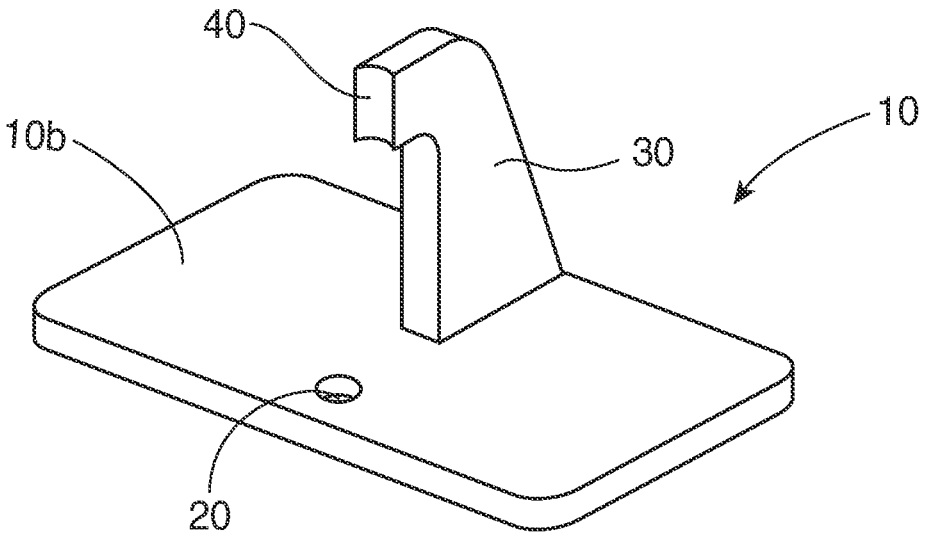
FIG. 2 is a bottom perspective view the shelf illustrated in FIG. 1.

As shown in the accompanying drawings, and with reference to FIGS. 1 and 2, at least one embodiment of the present invention is generally directed to a shelf 10 defining an upper surface 10*a* and a lower surface 10*b*. A bore, referenced as 20 is formed within the shelf 10 extending through and between the upper and lower surfaces 10*a*, 10*b* of the shelf 10. Attached to the lower surface 10*b* of the shelf is a brace 30, which, as described herein, assists in the mounting of the shelf 10 to a pole 100.

Figure 3:
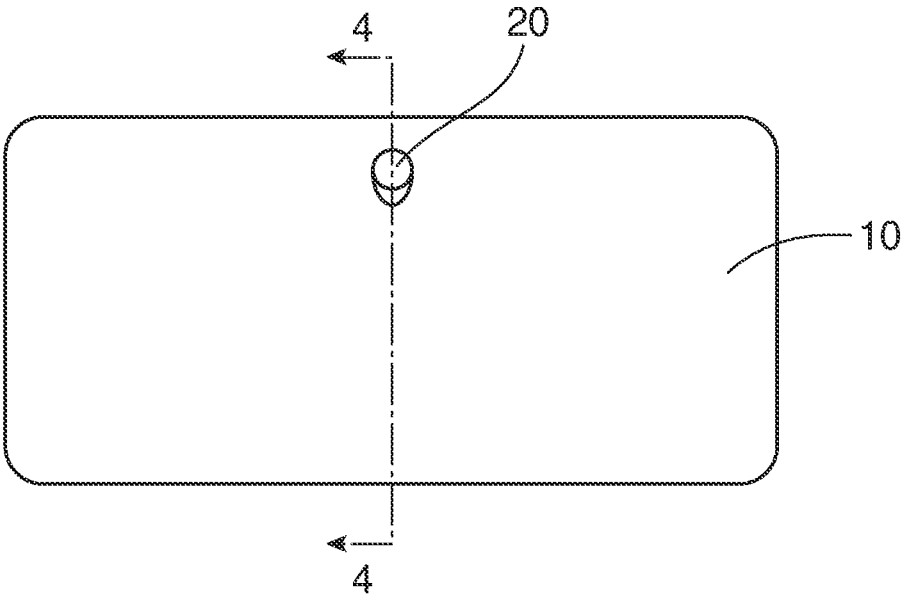
FIG. 3 is a top view of the shelf illustrated in FIGS. 1 and 2.
Figure 4:
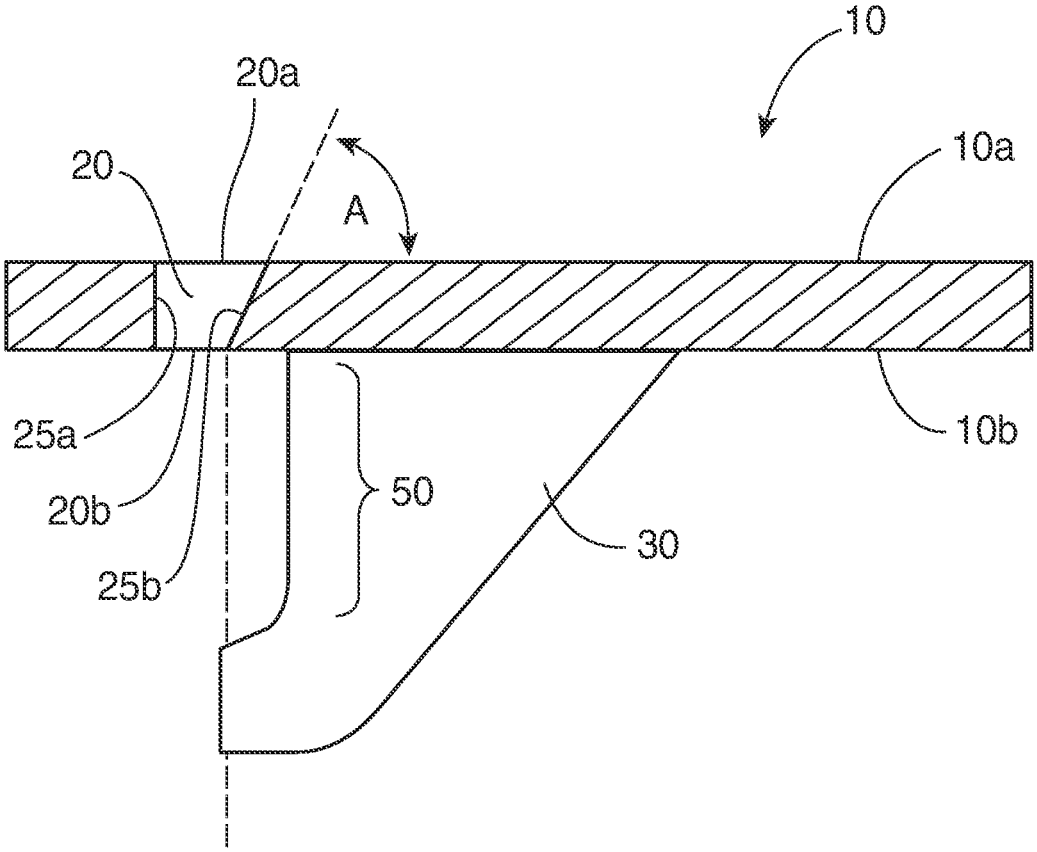
FIG. 4 is the cross-sectional view along lines 4-4 shown in FIG. 3.

More in particular, with reference now to FIGS. 3 and 4, the bore 20 of at least one embodiment of the present invention is characterized by having a non-cylindrical shape or otherwise a shape that is not a right cylinder shape. For example, in the embodiment shown, the shape of the bore 20 is swept out or formed by a cylinder as it is rotated from an orientation perpendicular to the shelf through an angle A that may range from about 5 degrees to about 40 degrees, preferably from about 10° to about 20°. For exemplary purposes only, a drill bit (or other like device that can form cylindrical bores) may first be used to form a right cylindrical bore by extending the drill bit perpendicularly through the shelf 10. With the drill bit still within the newly formed hole, the drill bit may be rotated from a perpendicular orientation, to an angled orientation relative to the shelf 10 forming an angled inside surface 25*b*. From this position, the drill bit may be swept in a semi-circular or side-to-side movement extending the lateral surface of the upper opening of the bore. It should also be noted that the bore 20, as described herein, can be formed through other techniques or manners, such that the above example should not be considered limiting.

In other words, in at least one embodiment of the present invention, the bore 20 may be formed by combining the shape of a right cylinder (a cylinder wherein the top surface and bottom surface are axially aligned) with the shape of an oblique cylinder (a cylinder wherein the top surface is axially offset from the bottom surface) such the opening or hole 20*a* at the top of the bore 20 is larger than opening or hole 20*b* at the bottom end of the bore 20. Furthermore, the opening or hole 20*a* at the top of the bore 20 may be oval, oblique or irregularly shaped. In this manner, with reference to the embodiment and cross-section illustrated in FIG. 4 the bore 20 may define a load-bearing interior wall, referenced as 25*a* which opposes an angled wall 25*b*.

Furthermore, it should be noted that the axis of rotation that defines angle A of at least one embodiment may be located at or below the plane defined by the lower surface 10*b* of the shelf, to maximize the length of the load-bearing surface 25.

In other embodiments, the bore may be formed using different methods and techniques such that the bore takes on a stadium-like shape with a top circular opening that is larger than and axially aligned with the bottom opening. In such an embodiment, each the internal walls of the bore will be angled.

Furthermore, the diameter D of the lower or bottom opening 20*b* of the bore 20 may, in some embodiments, range from one to two inches, and may be selected to just slightly exceed the outer diameter of the pole 100 upon which the shelf 10 is intended to be mounted. Other embodiments or implementations may include a bore 20 with a larger or smaller diameter D, depending on the particular application or use of the shelf 10. In any case, however, the closer the fit between the bore 20 and the pole 100, the less play the shelf 10 will have when mounted to the pole 100; therefore, the excess in diameter (e.g., the difference between the diameter D of the bore 20 and the outer diameter of the pole 100) should, in some cases, be just enough to permit friction-free and non-binding passage of the pole. Typically, the excess in diameter may range from 1/64 inch to 1/8 inch, although other ranges are contemplated within the full spirit and scope of the present invention.

Figure 5:
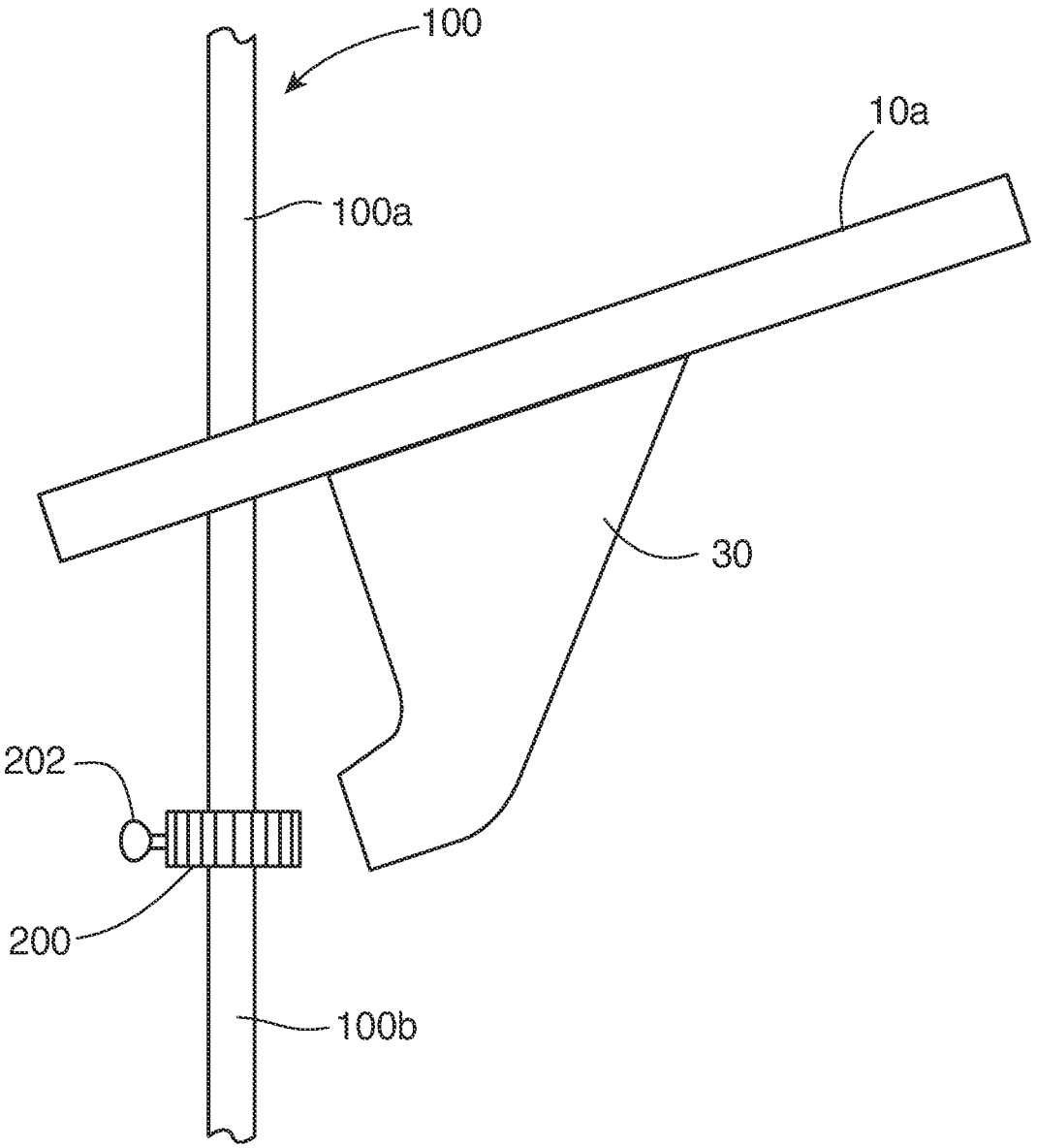
FIG. 5 illustrates a shelf of at least one embodiment of the present invention in the process of being mounted on a telescoping pole.

Moreover, the function of the non-cylindrical or other shaped bore 20 of at least one embodiment of the present invention is illustrated, for example, in FIG. 5, where the shelf 10 is shown tilted at such an angle that the brace 30 clears the pole clamp 200 as the shelf 10 is being slid over the upper pole section 100*a*. The angle A is selected by the practitioner to be large enough to permit brace 30 to clear most or all of the pole clamps 200 likely to be encountered on poles 100 of a given diameter. In alternative embodiments, the horizontal displacement is selected so as to obtain the same result.

Figure 6:
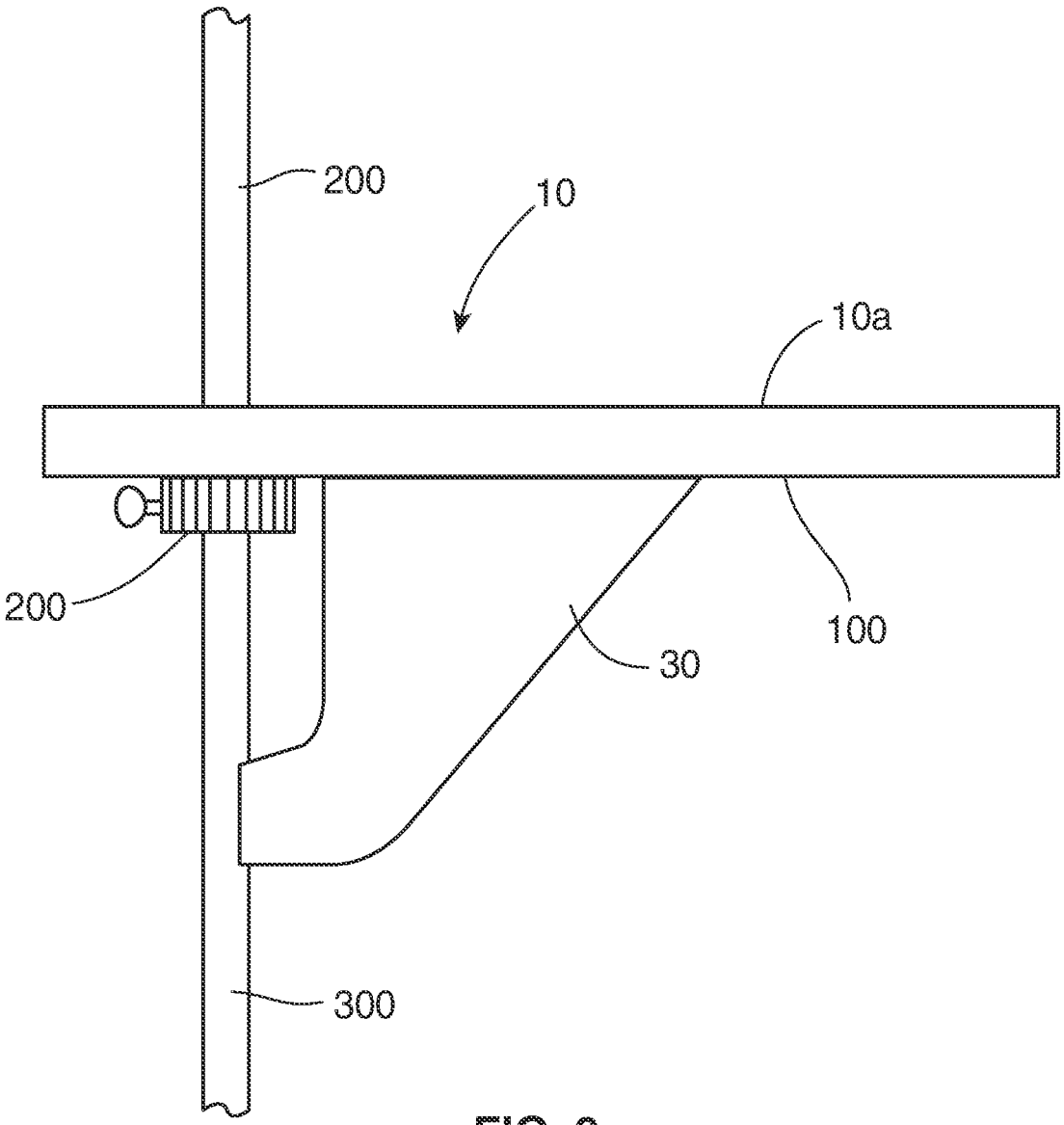
FIG. 6 illustrates a shelf of at least one embodiment of the present invention mounted on a telescoping pole and at least partially supported by the pole's compression clamp.

FIG. 6 shows the shelf 10 rotated into a horizontal or operable position after being placed over the upper pole section 100*a*.

Referring briefly again to FIGS. 1 and 2, the brace 30 of at least one embodiment features a cylindrical, curved or concave recess 40 on the surface on a contact end 35 that contacts or engages the pole 100. In particular, the curvature of this recess 40 of at least one embodiment is formed about a vertical axis and in some cases matches or corresponds to the curvature of the lower pole section 100*b*. In this manner, when the contact end 35 of the brace 30 engages or contacts with the pole 100, as shown, for example in FIG. 6, the nesting of the pole 100 within the recess 40 minimizes or restricts slippage or. movement of the brace 30 to either side of the pole 100. Slippage may be further restricted or inhibited by the presence of an optional strap (not shown), e.g. of hook-and-loop fabric, which secures the brace 30 to the pole 100.

Moreover, the vertical portion of the bore 20 and/or the lower opening 20*b* thereof, may closely fit the upper pole section 100*a*, so that when the shelf 10 is rotated into the horizontal or operable position, there is little or no play between the shelf 10 and the pole 100. The angled portion of the bore 20 can be made to fit less closely, for ease of placing the shelf over the pole prior to rotation into its working or operable position.

Additionally, in at least one embodiment, the section or wall 25*a* of the inner surface of the bore, herein designated the "bearing surface", is opposite from the brace 30 and bears a horizontal component of the forces conveyed to the pole 100 by the load on the shelf 10. This surface 25*a* in at least one embodiment conforms closely to the curvature of the pole 100 surface, so as to optimize the steadiness of the shelf 10.

Further, the brace 30 of at least one embodiment features a recessed section 50 disposed between the contact end 35 of the brace 30 and an upper end of the brace 32. In some embodiments, the recessed section 50 extends from the contact end 35 of the brace 30 all the way to the top end of the brace 30 or all the way to the lower surface 10*b* of the shelf 10, e.g., as shown in FIG. 4; however, in other embodiments, the recessed section 50 may extend only along a portion of the distance between the contact end 35 and the upper end 32 of the brace 30.

In any case, the recessed section 50 of at least one embodiment is adjacent to or otherwise faces the pole 100 when the shelf 100 is mounted in the operable position relative to the pole. This provides at least sufficient clearance for the pole clamp 200, and in some cases also provides enough clearance for any knobs 202 or levers that may be used to operate the clamp 200. In addition, the recessed section 50 of at least one embodiment extends away from the pole 100 and clamp 200 allowing enough clearance for the user to manually operate the clamp 200 regardless of its proximity to the brace 20. Greater clearances give the user more freedom to orient the shelf 10 and clamp 200 at will.

As shown in the exemplary embodiment of FIG. 6, the shelf 10, and in particular, the lower surface 10*b* of the shelf 10, may rest directly on the body of clamp 200, which in most cases is not movable vertically on the lower pole section 100*b*. In this manner, the shelf 10 is thus provided with a firmly fixed vertical position, with no tendency to slide downward regardless of the load it carries.

It should also be noted that in some cases the pole 100 may include one or more horizontally-oriented and vertically-spaced holes, through which one or more pins 210 may be disposed. More specifically, the pole 100 may include holes 110 that extend through the pole 100 (e.g., horizontally) through which a pin 210 may be disposed. The pole 100 may have a plurality of vertically spaced holes 110 allowing the user to select shelf height based on which one(s) of the holes 110 the pin is disposed.

In some cases, the pin 210 can be locked into place through a selected one of the holes 110, for example, via a locking loop, handle, nut, etc. In any case, the shelf 10 of at least one embodiment may rest directly or indirectly upon the pin 210 at a selected height, again with no tendency to slide downward.

For example, the lower surface 10*b* of the shelf 10 may rest upon the clamp 200 or pin 210, as described in accordance with at least one embodiment of the present invention.

Figure 7:
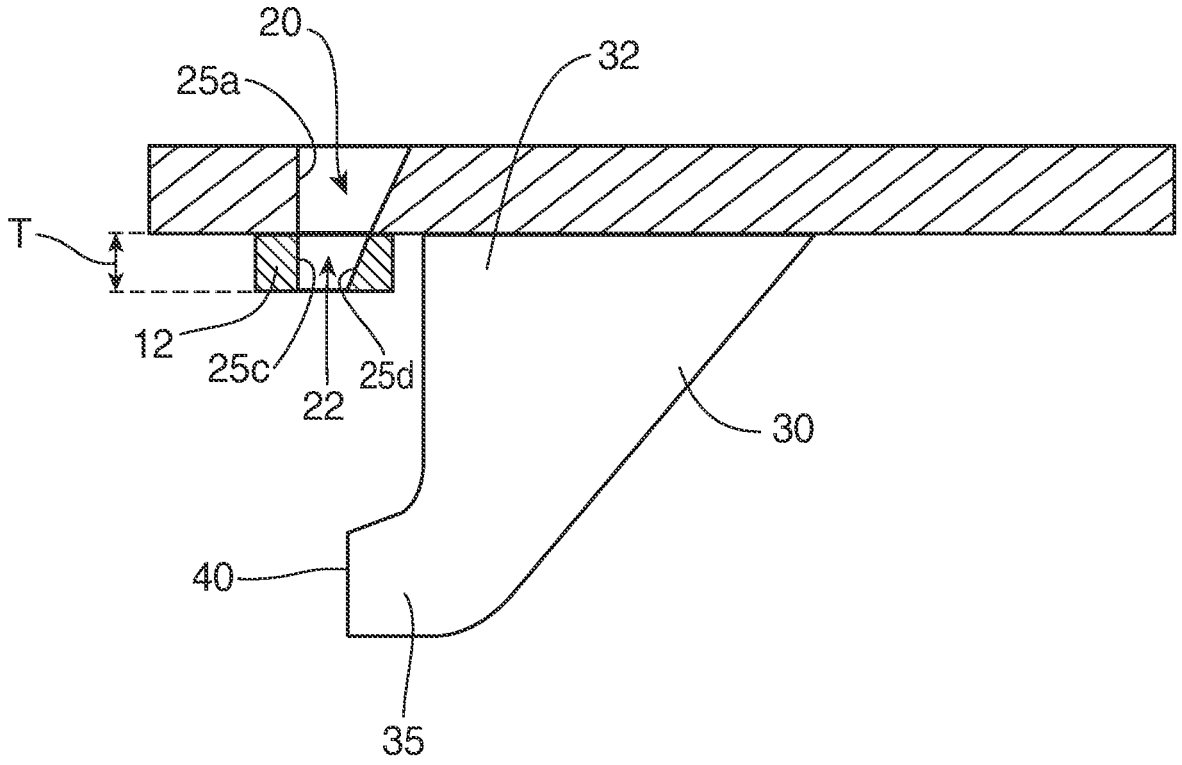
FIG. 7 is a cross-sectional view of another embodiment of the shelf as disclosed herein.
Figure 8:
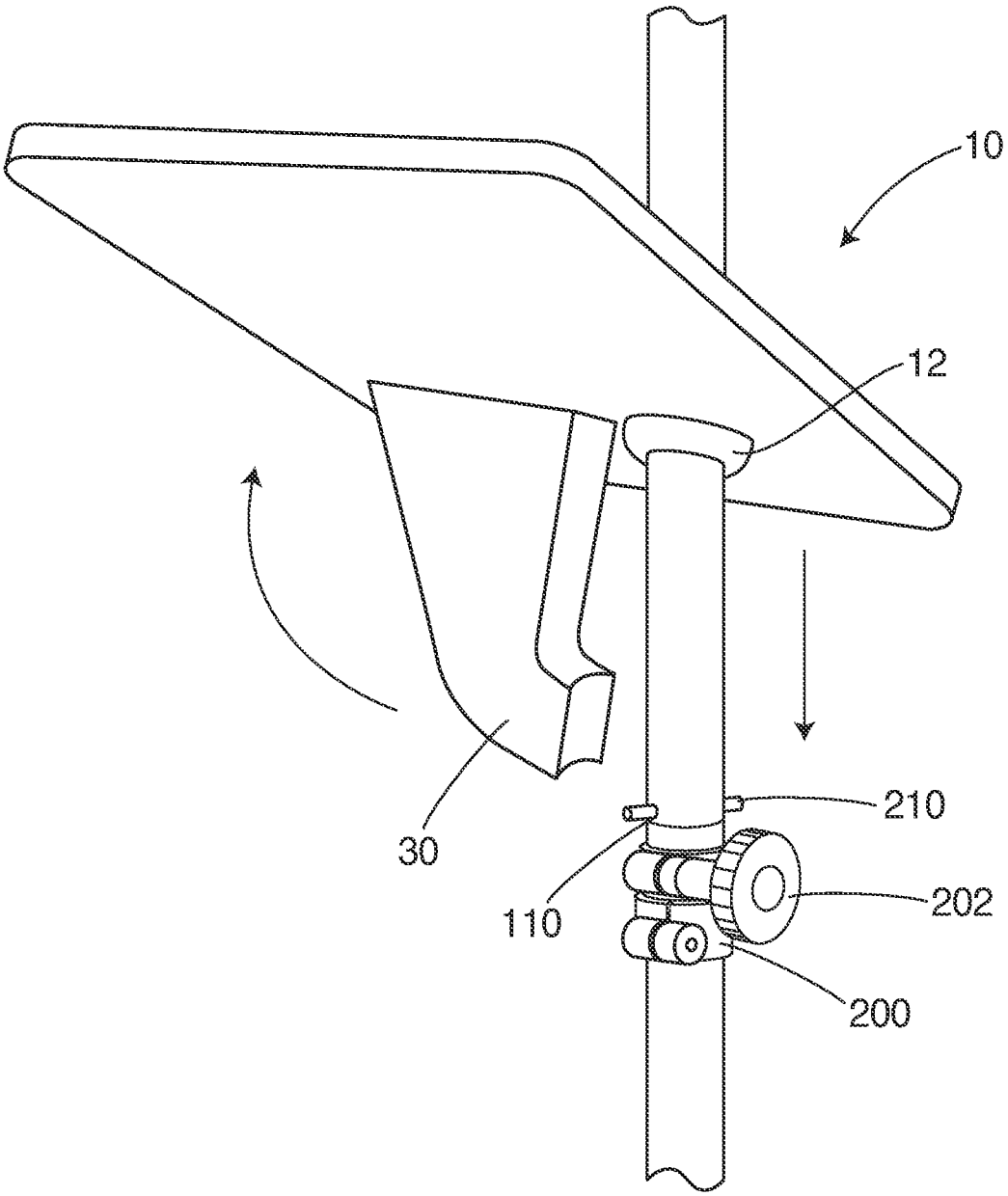
FIG. 8 illustrates a shelf of at least one embodiment of the present invention mounted on a pole and at least partially supported by a horizontal mounting pin.
Figure 9:
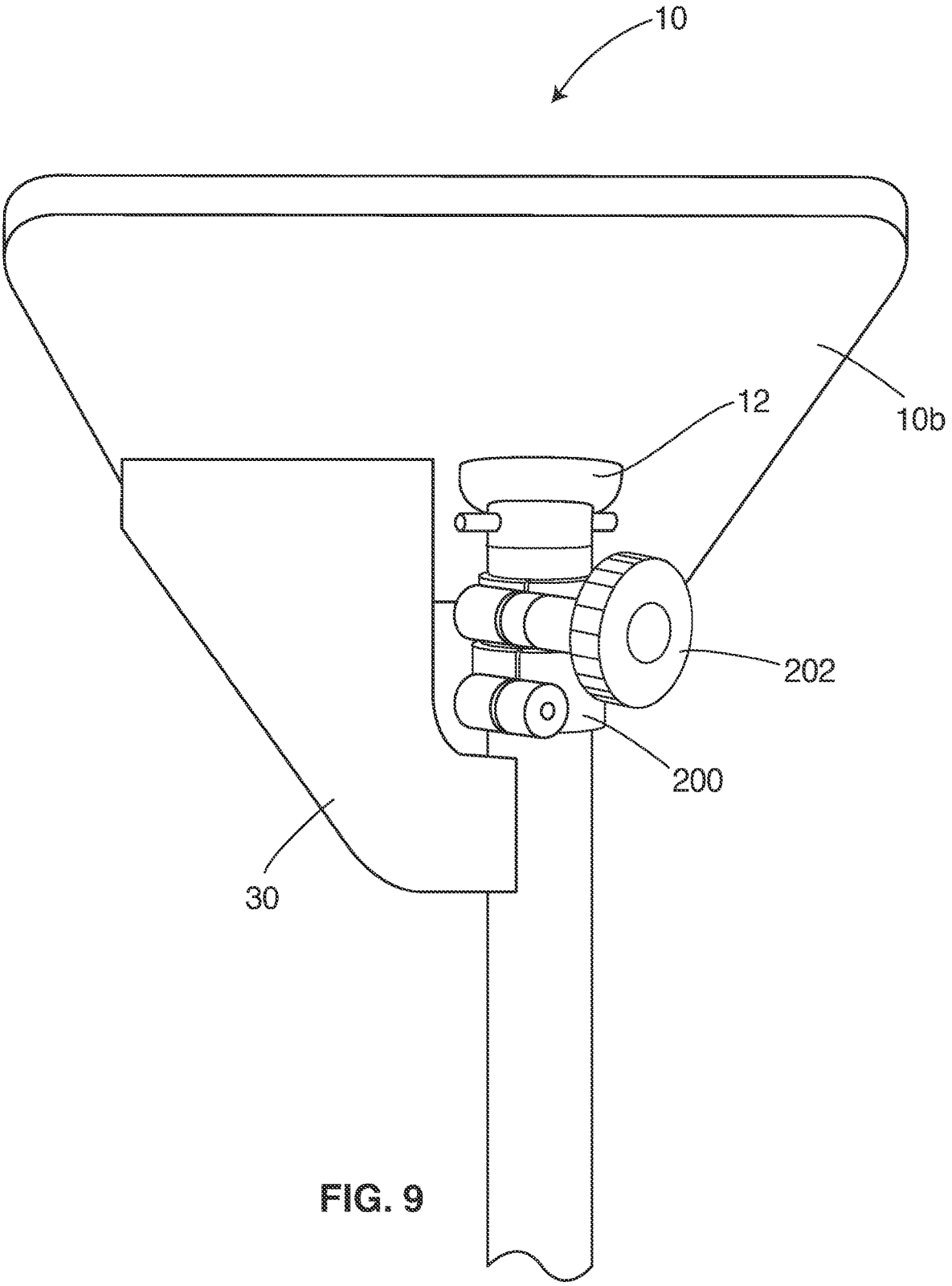
FIG. 9 is a partial bottom perspective view of the shelf of at least one embodiment mounted on a pole and at least partially supported by a mounting pin.

With reference to FIGS. 7, 8 and 9, in at least one embodiment, the shelf 10 may include an extension 12, also referred to a shim or washer, disposed on, against or near the lower surface 10*b* of the shelf 10, and in alignment or communication with the bore 20. As an example, the extension, shim or washer 12 may, in some cases, be affixed to or against the bottom surface 10*b* of the shelf 10, e.g., using one or more screws, nails, adhesive or other fasteners. In other cases, the extension or shim 12 may be integrally formed with the shelf 10 and/or separate from the shelf 10, so long as the extension 12 operates in the intended manner, as disclosed herein.

More specifically, in some embodiments, the extension 12 provides a neck, collar or surface which can contact or engage the pin 210 and/or clamp 200, described herein. Doing so provides clearance for the hardware associated with the clamp 200 or pin 210, including for example, but not limited to, a knob 202, handle, etc. which may be used to operate the clamp 200, tighten or secure the pin 210, etc.

Figure 10:
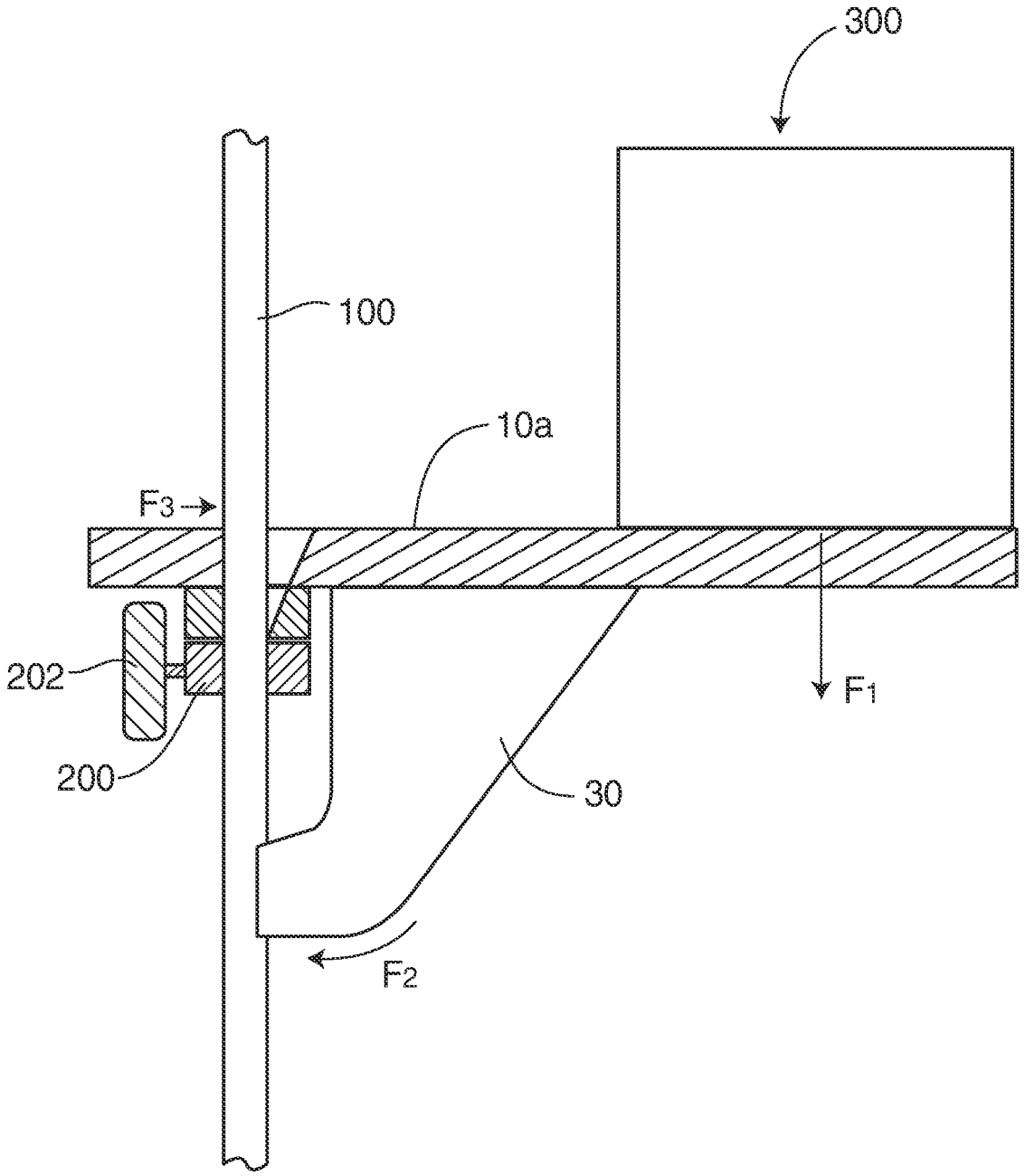
FIG. 10 is another cross-sectional view of the shelf as disclosed in accordance with at least one embodiment of the present invention.

More specifically, with reference to the cross-sectional view of FIGS. 7 and 10, the extension 12 of at least one embodiment include a thickness T that prevents or restricts the knob 202 or handle of the clamp 200 or pin 210 from engaging with or being interfered with by the lower surface 10*b* of the shelf 10.

Furthermore, as shown in the exemplary cross-sectional view of FIG. 7, the extension 12 of at least one embodiment includes an opening or extension bore 22 that matches or extends the contour and shape of the bore 20. More specifically, at least one or all of the interior wall or surfaces 25*c*, 25*d* of the extension 12 may continue along the same plane or orientation of corresponding surfaces 25*a*, 25*b*, respectively, of bore 20.

With reference again to FIG. 10, a cross-sectional view of at least one embodiment of the shelf 10 is shown in an operative position relative to the pole 100, and in use with an object 300 disposed on the upper surface 10*a* thereof. It should be noted that, in the example shown in FIG. 10, the object is placed at or near the outer edge of the shelf 100 and a distance away from the pole 100 or pole axis.

More specifically, F1 represents the generally downward force exerted upon the shelf 10 due at least in part to the weight of the object 300. As provided herein, the brace 20 of at least one embodiment contacts or engages the pole 100 via contact end 35 at a point below the shelf 10 surface, and in many instances, below the compression clamp 200, pin(s) 210, or other hardware that engages the pole 100. Reference F2 shows the force exerted, generally horizontally, upon the pole 10 at the contact end 35 of the brace 20. In addition, F3 shows another force that is exerted, generally horizontally, upon the pole 100 within the bore 10 and in particular against bearing surface 25*a*. The forces F2 and F3 reduce the downward force exerted upon the clamp 200, pin(s) or other like hardware directly below the shelf 10 surface. This, in turn, significantly increases the amount of weight or force that can be exerted upon the shelf 10 without causing failure in the shelf or pole.

Figure 11:
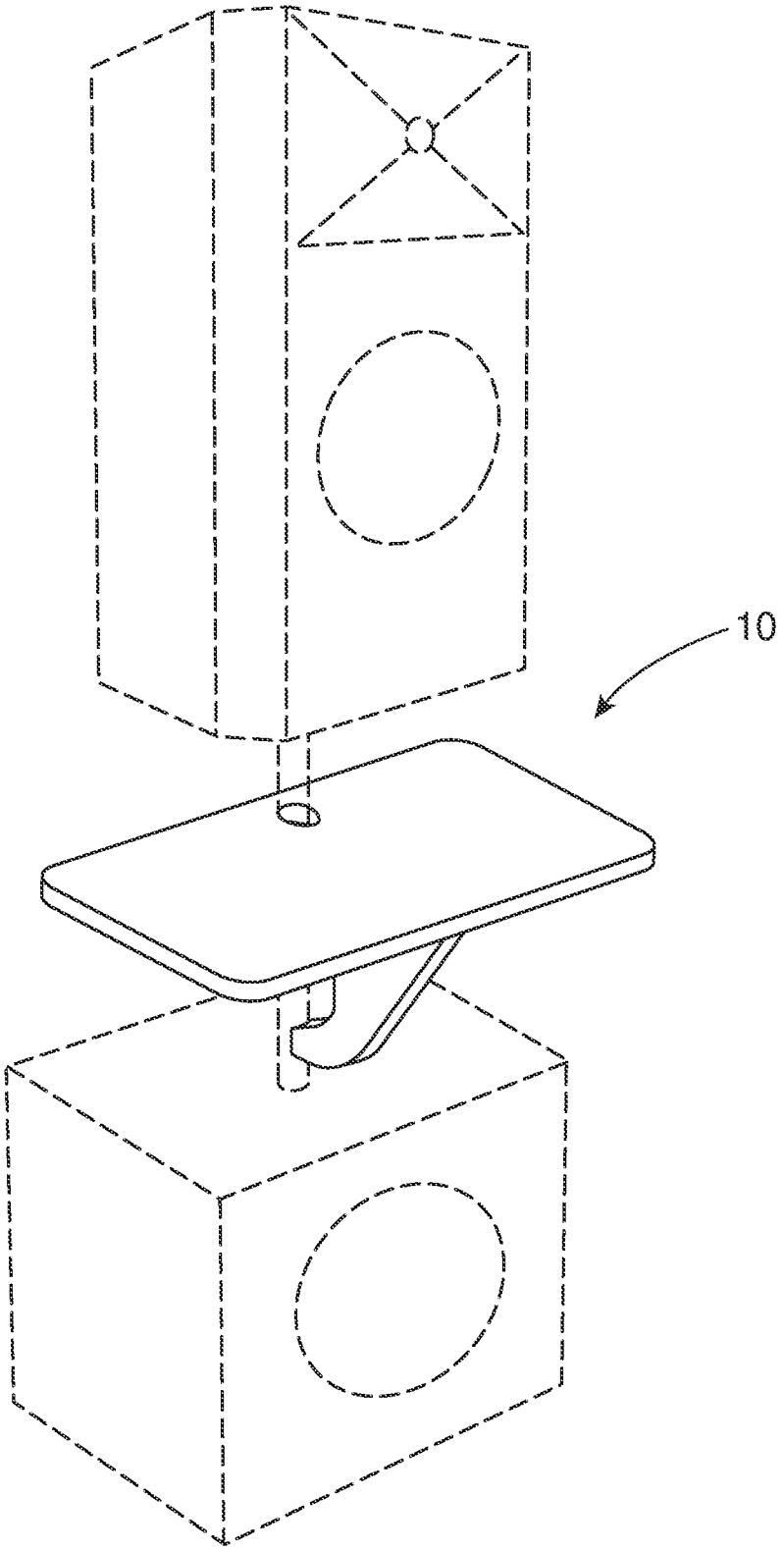
FIG. 11 illustrates the shelf of at least one embodiment in an exemplary in-use environment.
Figure 12:
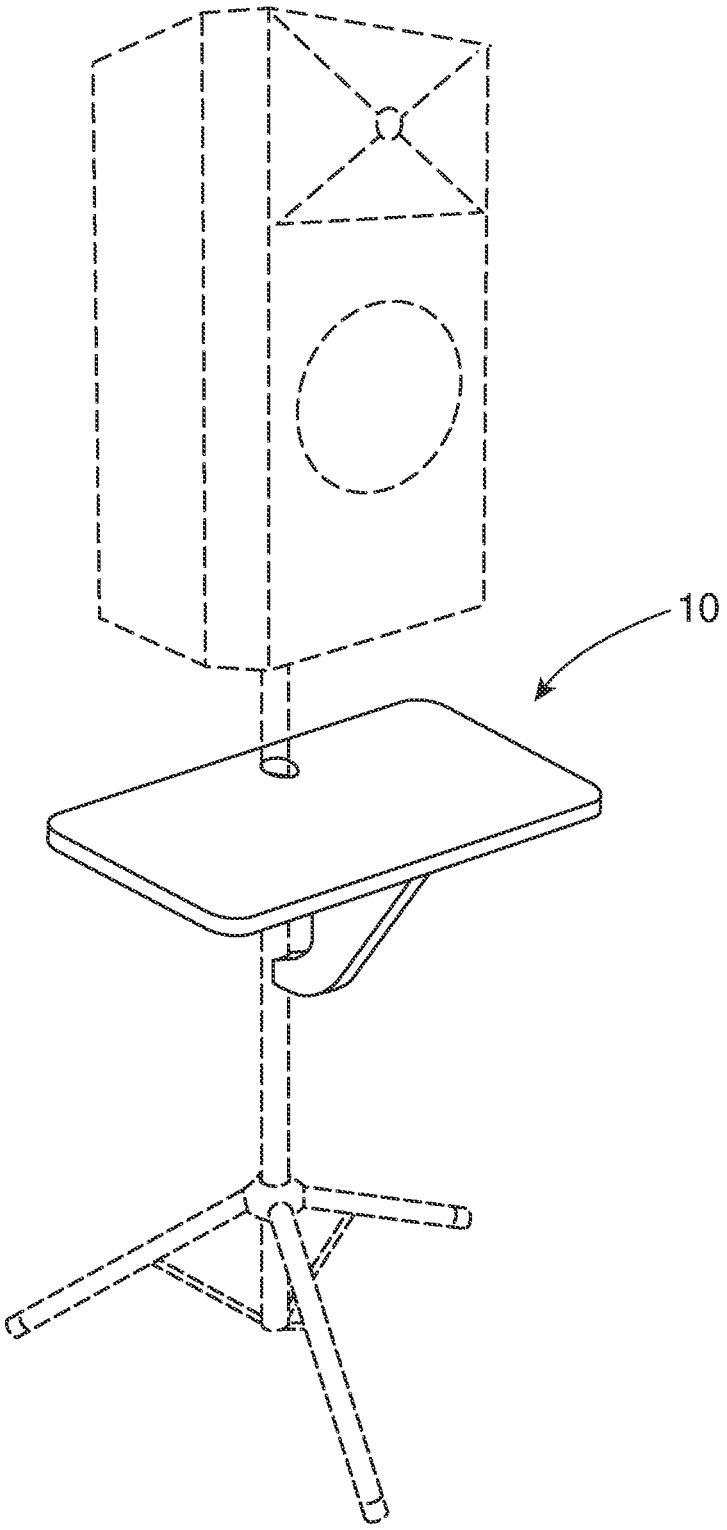
FIG. 12 illustrates the shelf of at least one embodiment in another exemplary in-use environment.
Figure 13:
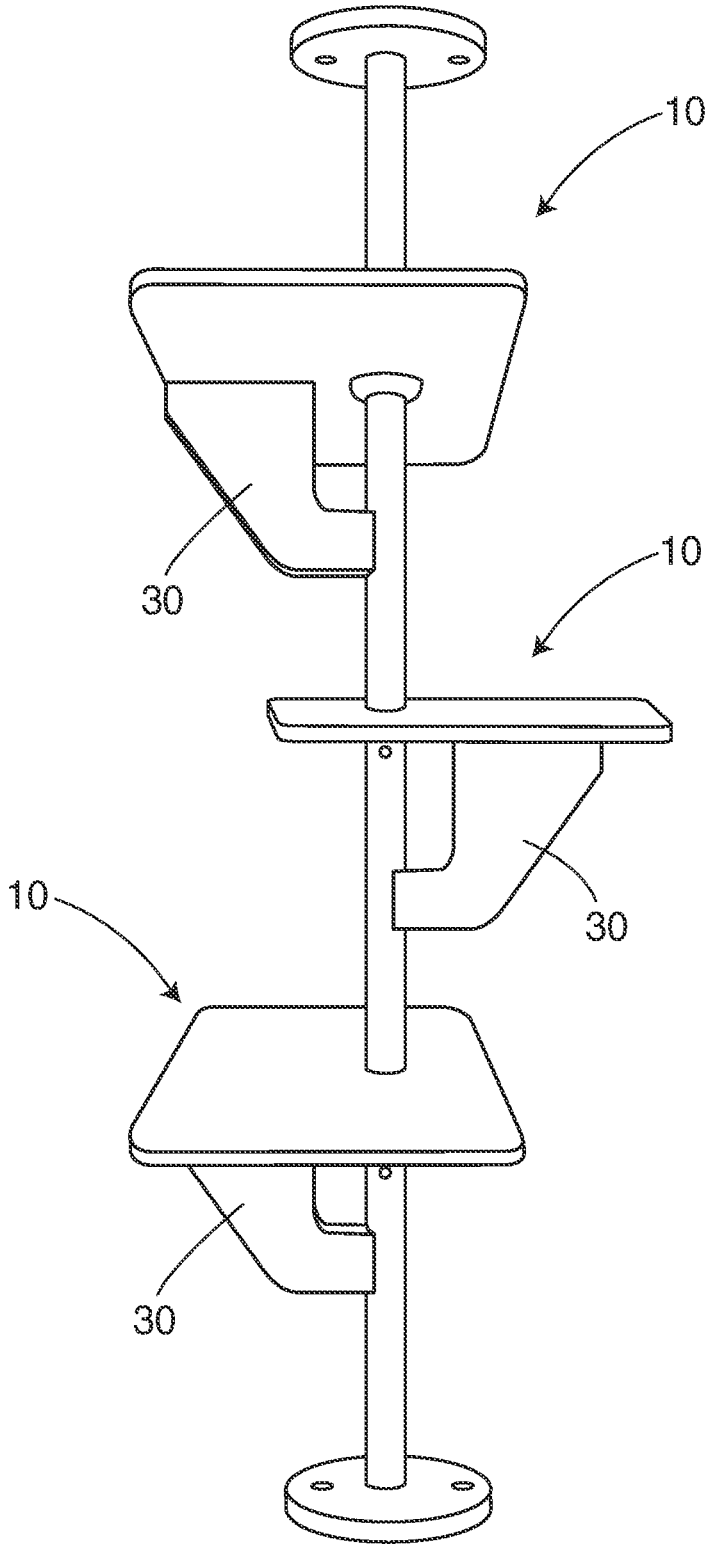
FIG. 13 illustrates the shelf of at least one embodiment in yet another exemplary in-use environment.

FIGS. 11-13 illustrate exemplary operative non-limiting uses of one or more of the shelves 10, as disclosed in accordance with at least one embodiment.

In addition, the embodiments of the present invention shown have a simple construction, wherein the shelf 10 itself is thick enough to provide for a stable interaction with the pole 100 along the bearing surface 25*a* that is free of tilt and wobble or otherwise minimizes tilt and wobble. A suitable thickness, in practice, has been found to be about 0.75 to 1.0 inches. In some cases, if a thinner shelf is desired, e.g. to save on weight and materials, the thickness of the shelf around the bore 20 may be effectively increased using the extension 12, described above. A representative cross-section is that shown in FIG. 7, where a ½-inch thick shelf is augmented by a ½-inch thick extension, supplementing the bearing surface 25*a* with additional bearing surface 25*c* and thereby providing a bore exactly equivalent to that of a 1-inch thick shelf.

Furthermore, the brace 30 in the illustrated embodiments is thick enough to provide for an adequately wide recess 40, complimentary in shape to lower pole section 102*b*, which ensures a stable contact between the brace 30 and the pole 100 when a load is placed on the shelf. The brace 30 may advantageously and economically be constructed from a single piece of wood or plywood of the desired thickness, typically between about ¾ inches and about 1¾ inches. In practice, wood having a thickness of about 1.5 inches has been found suitable for the pole diameters commonly in use. Much thinner plastic, aluminum, or composite equivalents can be readily envisaged, featuring in place of recess 40 a receiver of complimentary shape to lower pole section 300.

The brace 30 may be permanently fixed to the shelf 10 by means known in the woodworking arts, including but not limited to nails, screws, bolts, and/or adhesives. Joining hardware reaching through to the upper surface will preferably be recessed or made flush with the upper surface.

In at least one embodiment, the brace 30 may be attached to shelf 10 with one or more hinges, or a piano hinge, so that the device can be folded flat for transport or storage. Such hinged embodiments may feature a high-friction hinge, and/or be provided with a means for reversibly locking the brace into its operating position perpendicular to the shelf, including but not limited to hook-and-loop surfaces, locking hinge brackets and articulated brackets and braces. Suitable structures and devices for reversibly locking a hinged component at right angles to its folded position are well-known in the furniture and woodworking arts, for example in the construction of folding and drop-leaf tables. Representative examples may be found, for example, in U.S. Pat. No. 10,485,333 and in the references cited therein.

The brace 30 may optionally be removably attached to the shelf by any means known in the art for reversible fastening, for example via tab-and-slot, magnetic, twist-lock, or snap-on fittings, or hook-and-loop surfaces.

Alternative methods and materials will be apparent to those of skill in the mechanical and manufacturing arts. By way of example, the shelf and brace may independently be constructed of wood, thermoplastic or thermoset resins, metals, or fiber-reinforced composite materials. The shelf and brace need not be as thick as the illustrated embodiment, but can instead be formed from thinner but still sufficiently rigid materials, and provided with sleeves and pads that provide the necessary surface areas at the points of contact with the pole.

The upper surface of the shelf is not limited to the featureless plane shown in the illustrated embodiments. A tilting support for holding a tablet, laptop computer, or printed material at a desired viewing angle can be provided, as well as any desired pins, pegs, recesses, ledges, wire harnesses, and the like, designed for any particular application or device intended to be supported. The shelf may thus be adapted to support a keyboard or a mini mixing board, for example. The upper surface can be provided with a soft foam or elastomer pad if desired, to prevent slipping and/or vibration of the supported device or object. Suitable high-friction elastomers include but are not limited to soft silicones and thermal plastic urethane (TPU).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

The invention claimed is:

1. A device mountable on a pole, comprising:

a shelf defining an upper surface and a lower surface, a non-cylindrical bore extending through the shelf between said upper surface and said lower surface, a brace extending from said lower surface of said shelf and comprising a contact end a spaced distance from said lower surface of said shelf, said contact end of said brace being in contact with the pole when the shelf is disposed in an operable position, and wherein said bore comprises an upper hole disposed at said upper surface of said shelf and a lower hole disposed at said lower surface of said shelf, wherein said upper hole has a larger area than said lower hole.

2. The device as recited in claim 1 wherein the bore comprises a volumetric shape swept out by a cylinder rotated from an orientation perpendicular to said shelf to an angular orientation relative to said shelf.

3. The device as recited in claim 2 wherein said angular orientation comprises an angle of between five degrees and forty degrees relative to said shelf.

4. The device as recited in claim 3 wherein said bore has the shape of a volume swept out by a cylinder as the cylinder is rotated through an angle of between fifteen degrees and thirty-five degrees.

5. The device as recited in claim 1 wherein said bore comprises an angular inner surface and a load bearing surface, said load bearing surface being opposite said angular inner surface.

6. The device as recited in claim 5 wherein said load bearing surface and said brace are on opposite sides of said bore.

7. The device as recited in claim 6 wherein said brace comprises a recessed section disposed between said contact end and said lower surface of said shelf.

8. The device as recited in claim 6 wherein said brace is affixed to said lower surface of said shelf.

9. The device as recited in claim 6 wherein said brace is removably affixed to said lower surface of said shelf.

10. The device as recited in claim 6 wherein said brace is pivotally mounted to said lower surface of said shelf.

11. The device as recited in claim 6 wherein an object disposed on said upper surface of said shelf creates a first force in a downward direction upon said shelf, which causes a second force to exert against the pole by said contact end and a third force to exert against the pole by said load bearing surface of said bore.

12. The device as recited in claim 1 further comprising an extension disposed on said lower surface of said shelf and in communication with said bore.

13. The device as recited in claim 12 wherein said extension comprises an extension bore that corresponds with the shape of said bore of said shelf.

14. The device as recited in claim 13 wherein said extension comprises a thickness that provides clearance under said shelf for mounting hardware.

15. A device mountable on a pole, comprising:

a shelf defining an upper surface and a lower surface, a non-cylindrical bore extending through the shelf between said upper surface and said lower surface, a brace extending from said lower surface of said shelf and terminating at a contact end a distance from said lower surface of said shelf, wherein said bore comprises an upper hole disposed at said upper surface of said shelf and a lower hole disposed at said lower surface of said shelf, wherein said upper hole has a larger area than said lower hole such that the shelf is mountable to the pole by sliding shelf onto the pole through said bore at an initially non-perpendicular orientation, which allows said brace to clear mounting hardware disposed on said shelf, and then to a perpendicular, operative orientation, said perpendicular, operative orientation defined as said shelf being perpendicularly disposed relative to said pole, and said contact end of said brace being in contact with the pole while said shelf is disposed in said perpendicular, operative orientation.

16. The device as recited in claim 15 wherein said bore comprises an angular inner surface and a load bearing surface, said load bearing surface being opposite said angular inner surface.

17. The device as recited in claim 16 wherein an object disposed on said upper surface of said shelf creates a first force in a downward direction upon said shelf, which causes a second force to exert against the pole by said contact end and a third force to exert against the pole by said load bearing surface of said bore.

18. The device as recited in claim 17 wherein said brace comprises a recessed section disposed between said contact end and said lower surface of said shelf.

19. The device as recited in claim 18 wherein the bore comprises a volumetric shape swept out by a cylinder rotated from an orientation perpendicular to said shelf to an angular orientation relative to said shelf.

20. The device as recited in claim 19 further comprising a shim disposed on said lower surface of said shelf and in communication with said bore, said shim comprising a thickness to provide clearance for mounting hardware.

* * * * *